US010799807B2

(12) United States Patent
Derraugh

(10) Patent No.: US 10,799,807 B2
(45) Date of Patent: Oct. 13, 2020

(54) BOARD FOR USE AS A BOOK PAGE OR PUZZLE WITH MOVING COMPONENT THAT ALTERS AN ILLUSTRATION AND EXPOSES A SENSOR TO ACTIVATE A CORRESPONDING SOUND

(71) Applicant: William Derraugh, Brooklyn, NY (US)

(72) Inventor: William Derraugh, Brooklyn, NY (US)

( * ) Notice: Subject to any disclaimer, the term of this patent is extended or adjusted under 35 U.S.C. 154(b) by 0 days.

(21) Appl. No.: 16/213,848

(22) Filed: Dec. 7, 2018

(65) Prior Publication Data

US 2019/0176050 A1 Jun. 13, 2019

Related U.S. Application Data

(60) Provisional application No. 62/595,864, filed on Dec. 7, 2017.

(51) Int. Cl.

| | |
|---|---|
| ***A63H 33/38*** | (2006.01) |
| ***A63F 9/06*** | (2006.01) |
| ***A63F 9/10*** | (2006.01) |
| *A63F 9/24* | (2006.01) |

(52) U.S. Cl.

CPC ..... *A63H 33/38* (2013.01); *A63F 9/0613* (2013.01); *A63F 9/10* (2013.01); *A63F 2009/064* (2013.01); *A63F 2009/1061* (2013.01); *A63F 2009/247* (2013.01); *A63F 2009/2444* (2013.01)

(58) Field of Classification Search

CPC .... A63F 9/0613; A63F 9/10; A63F 2009/064; A63F 2009/2444; A63F 2009/1061; A63F 2009/247; A63H 33/38

USPC ..... 446/147, 148, 149, 150

See application file for complete search history.

(56) References Cited

U.S. PATENT DOCUMENTS 6,525,706 B1 * 2/2003 Rehkemper ..... G09B 5/06 345/87

FOREIGN PATENT DOCUMENTS

EP 0609048 A1 * 8/1994 ..... B42D 3/123

* cited by examiner

*Primary Examiner* — Vishu K Mendiratta

(74) *Attorney, Agent, or Firm* — Tope-McKay & Associates

(57) ABSTRACT

Described is a board that is operable as a children's book or puzzle with parts that move, slide or turn on one lateral plane to physically change an illustration or part of the item and, as they slide or turn, activate a noise related to the illustration. The board includes a generally planar top illustrative layer. A bottom base layer is attached with the top illustrative layer. The bottom base layer includes a light sensor and sound generation components for generating a sound based upon actuation of the light sensor. A moving component is movably connected with the bottom base layer. Finally, the light sensor is connected with the bottom base layer and positioned such that moving the moving component from a first position to a second position exposes the light sensor to cause the sound generation components to generate a sound.

6 Claims, 7 Drawing Sheets

BOARD FOR USE AS A BOOK PAGE OR PUZZLE WITH MOVING COMPONENT THAT ALTERS AN ILLUSTRATION AND EXPOSES A SENSOR TO ACTIVATE A CORRESPONDING SOUND

CROSS-REFERENCE TO RELATED APPLICATIONS

The present application is a non-provisional application of U.S. Provisional Application No. 62/595,864, filed on Dec. 7, 2017, the entirety of which is incorporated herein by reference.

BACKGROUND OF THE INVENTION

(1) Field of Invention

The present invention relates to children's books and puzzles and, more particularly, to a book or puzzle with parts that slide or turn on one lateral plane to physically change an illustration or part of the item and, as they slide or turn, activate a noise related to the illustration.

(2) Description of Related Art

This disclosure is directed to the field of sound generating books and puzzles. In the art there are books that have moving pieces that slide or turn on one lateral plane, changing an illustration as they do so. The moving action piece includes an illustration or part of an illustration that is visually and physically changed with the movement of the piece. However, such a movement does not cause any sound to be produced.

There are also books that make an electronic sound when a button is pressed. The button may be implanted in the pages or may be on an attached plastic unit. The button may have an image on it corresponding to the sound it will make. The button when pressed activates a switch which causes an electronic sound to be produced. However, the button in such a device only engages the auditory senses. Pressing the button does not result in any other movement or change an illustration.

Further, puzzles exist that make a noise when a piece is removed to expose a light sensor. These puzzles engage both auditory and visual senses, but they do not include a movement that physically changes an illustration. They also have a disadvantage in that the pieces can be separated from the puzzle board containing the sound unit, thus losing the interrelationship of picture and sound.

Thus, a continuing need exists for a book or puzzle with parts that slide or turn on one lateral plane to physically change an illustration or part of the item and, as they slide or turn, they activate a noise related to the illustration.

SUMMARY OF INVENTION

The present disclosure is directed to a board that is operable as a children's book or puzzle with parts that move, slide or turn to physically change an illustration or part of the item and, as they move, slide or turn, activate a noise related to the illustration. The board includes a generally planar top illustrative layer. A bottom base layer is attached with the top illustrative layer. The bottom base layer includes a light sensor and sound generation components for generating a sound based upon actuation of the light sensor. A moving component is movably connected with the bottom base layer. Finally, the light sensor is connected with the bottom base layer and positioned such that moving the moving component from a first position to a second position exposes the light sensor to cause the sound generation components to generate a sound.

In another aspect, moving the moving component form the first to second position alters an illustration as viewable by a user and, in doing so, exposes the light sensor.

In yet another aspect, the moving component is movably connected in a lateral plane between the top illustrative layer and the bottom base layer such that at least a portion of the moving component is sandwiched between the top illustrative layer and the bottom base layer.

In yet another aspect, the moving component is slidably sandwiched between the top illustrative layer and bottom base layer.

Further, the moving component is pivotally sandwiched between the top illustrative layer and bottom base layer.

In another aspect, the top illustrative layer, moving component, and bottom base layer collectively form a page of a book.

In yet another aspect, the board is a puzzle board, such that the top illustrative layer includes a cut-out shape and the moving component is formed to match with and fit within the cut-out shape.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1A:
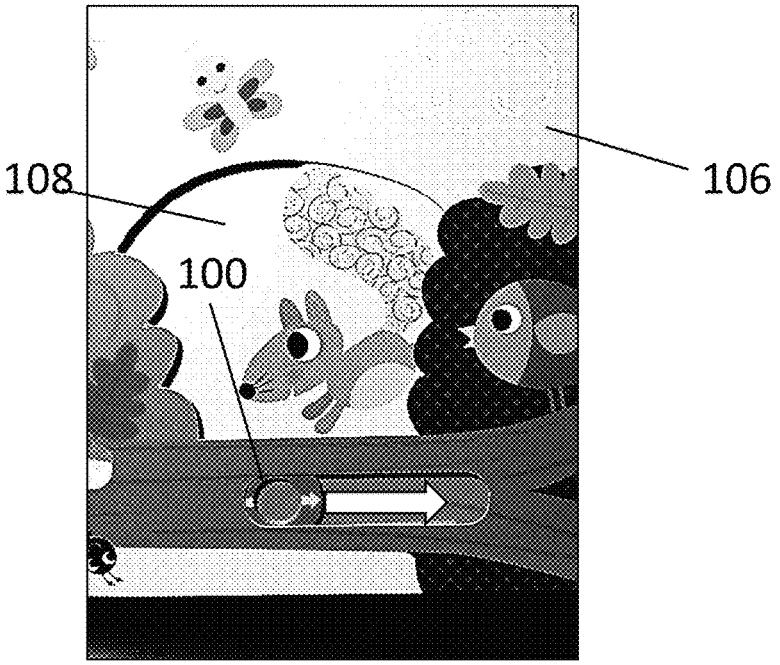
FIG. 1A is an illustration of a page or puzzle piece with a moving component in a first position.

The present invention relates to children's books and puzzles and, more particularly, to a book or puzzle with parts that slide or turn on one lateral plane to physically change an illustration or part of the item and, as they slide or turn, activate a noise related to the illustration. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

This disclosure is directed to a board that operates as a page of a book or as a puzzle board with one or more action pieces (moving component) that slide or turn on a lateral plane to physically change an illustration or part of the item. Further and of particular importance, as the action piece slides or turns, a light sensor or other sensor or actuatable element is actuated to activate a noise related to the illustration. For example, the book or puzzle includes moving component is that activate sound on the pages of a board book or a board/wood puzzle (or other suitable object).

In various aspects and as shown in FIGS. 1A through 7B, the moving component 100 mechanisms work by exposing a light sensor 102 (e.g., a light receptor positioned underneath the moving action piece) that are attached to wires or otherwise connected to sound generation components, such as a circuit board and/or speaker 104. The moving component 100 may be moved laterally (e.g., slid or rotated) to alter the illustration of the book or puzzle and, further, expose an implanted light sensor 102 fastened to the surface underneath the action piece 100. In another example, the light sensor may be attached to a moving component and is exposed when the piece is moved.

The moving component 100 can be implanted in the board (book or puzzle) or secured by a fastener such as a rivet on top of the board that would allow the action piece to rotate. As can be appreciated by those skilled the art and in various aspects, the moving component 100 can be a piece of paperboard or other material that can be slid between layers of the book or puzzle or rotated through a pivotal connection, or lifted off as in puzzle configuration.

Submitted herewith are several images of non-limiting examples of moving action pieces (components) 100 that can be slid or rotated to alter the illustration and expose a sensor 102.

Figure 1B:
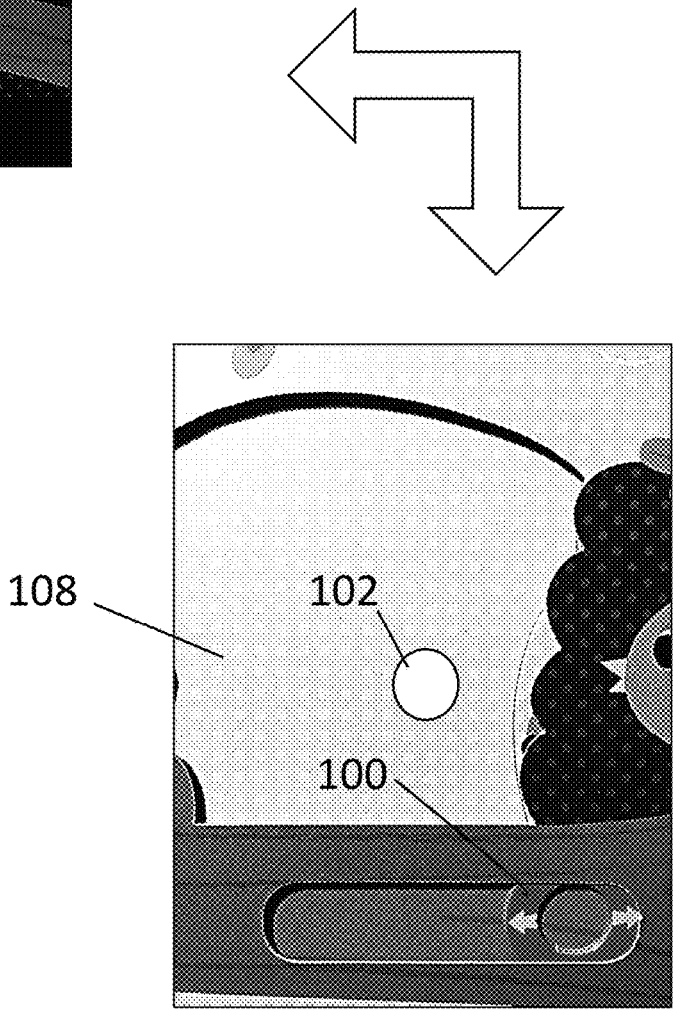
FIG. 1B is an illustration of the page or puzzle piece as shown in FIG. 1A, depicting the moving component in the second position to expose a sensor.

For example and as shown in FIGS. 1A and 1B, the moving component 100 is sandwiched between a top illustrative layer 106 and a bottom base layer 108. In this non-limiting example example, the moving component 100 include a finger tab which is part of and extends from the illustrative portion (e.g., squirrel image). A user could then use the finger tab and slide the moving component 100 laterally, causing the illustrative portion to move (hiding the squirrel behind the bush) and expose the light sensor 104 embedded in the bottom base layer 108. Once the light sensor 104 is exposed, the attached circuitry and/or speaker 104 emit the pre-programmed sound (e.g., such as a squirrel chirping, etc.).

Figure 2A:
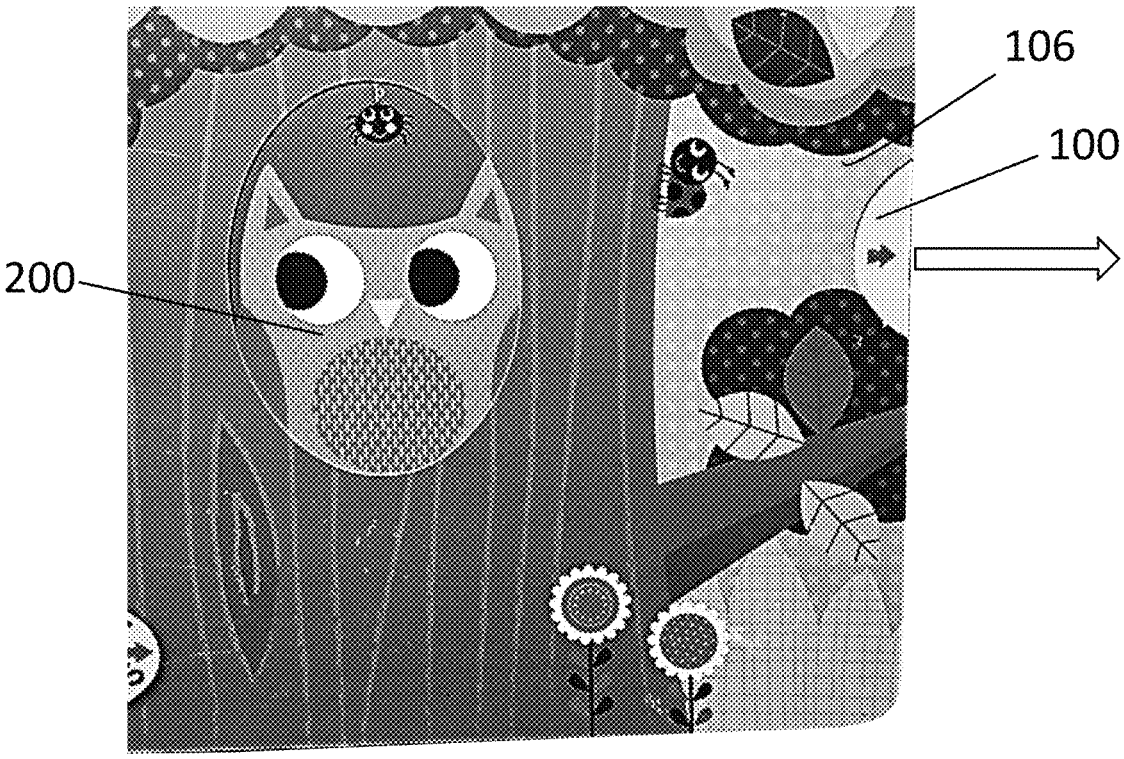
FIG. 2A is an illustration of a page or puzzle piece with a moving component in a first position.
Figure 2B:
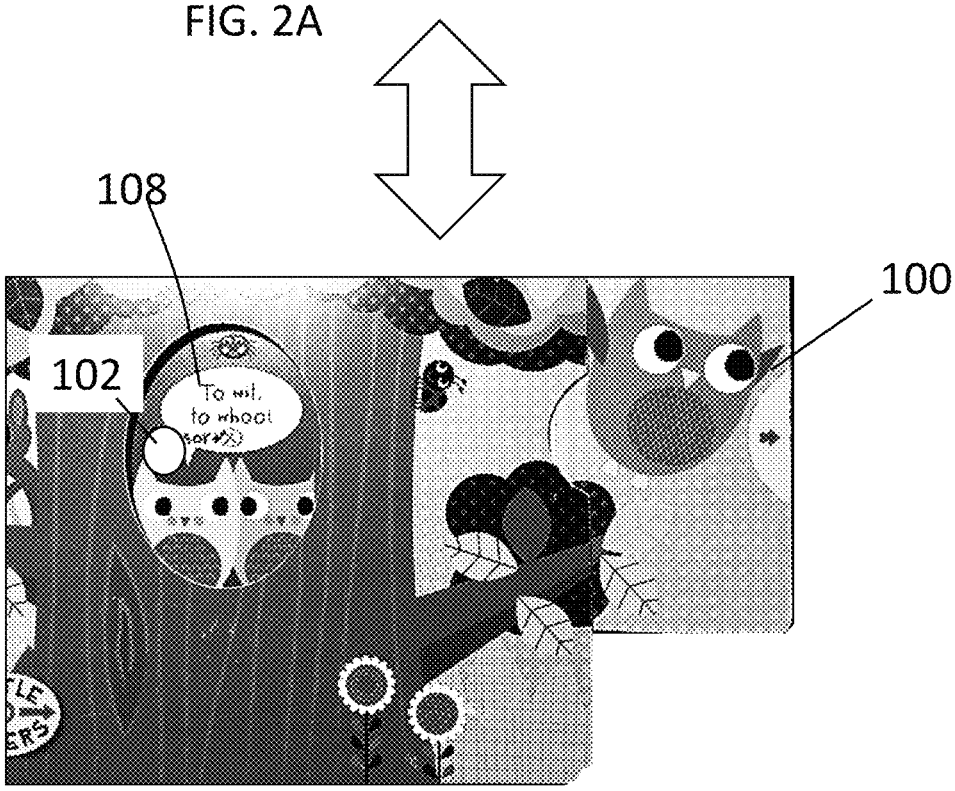
FIG. 2B is an illustration of the page or puzzle piece as shown in FIG. 2A, depicting the moving component in the second position to expose a sensor.

Yet another non-limiting example is depicted in FIGS. 2A and 2B. In this example, pulling the moving component 100 (e.g., pull tab) causes the attached illustrative portion to pull the sitting owl 200 to be concealed by sliding under the top illustrative layer 106, while revealing the baby owls and a flying away owl printed on the bottom base layer 108 and also exposing the light sensor 102 to cause the corresponding sound to be emitted. In this example, as the moving component 100 is slid out from behind the illustrative layer, the newly revealed moving component 100 actually expands the overall illustrative area as shown.

Figure 3A:
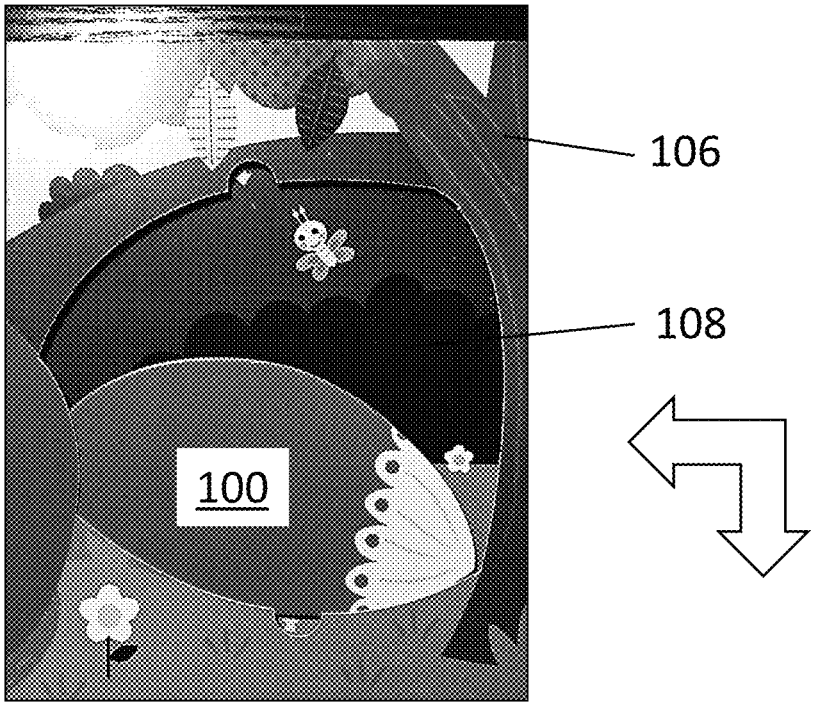
FIG. 3A is an illustration of a page or puzzle piece with a moving component in a first position.
Figure 3B:
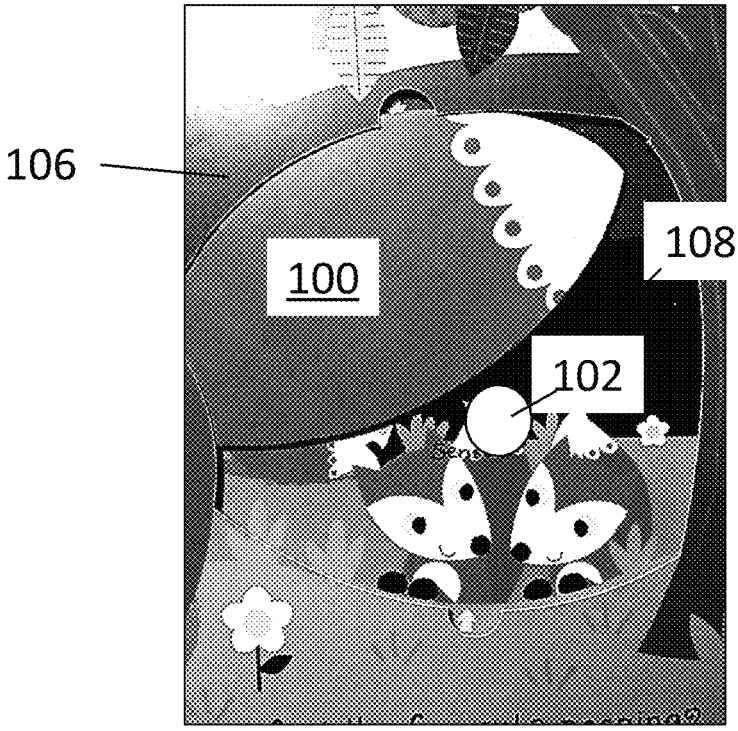
FIG. 3B is an illustration of the page or puzzle piece as shown in FIG. 3A, depicting the moving component in the second position to expose a sensor.

In yet another example and as shown in FIGS. 3A and 3B, the moving component 100 can be rotatably connected between the top illustrative layer 106 and the bottom base layer 108. In this aspect, rotating the moving component 100 (e.g., fox's tail) exposes the illustration printed upon the base layer (e.g., baby foxes) and the light sensor 102 to cause the corresponding sound to be emitted.

Figure 4A:
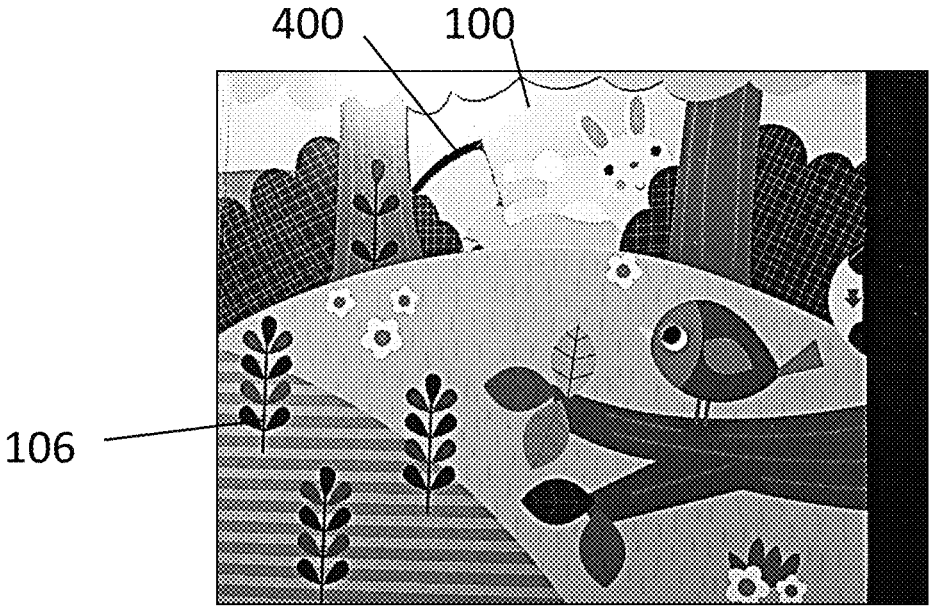
FIG. 4A is an illustration of a page or puzzle piece with a moving component in a first position.
Figure 4B:
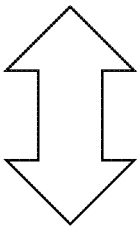
FIG. 4B is an illustration of the page or puzzle piece as shown in FIG. 4A, depicting the moving component in the second position to expose a sensor.
Figure 4B:
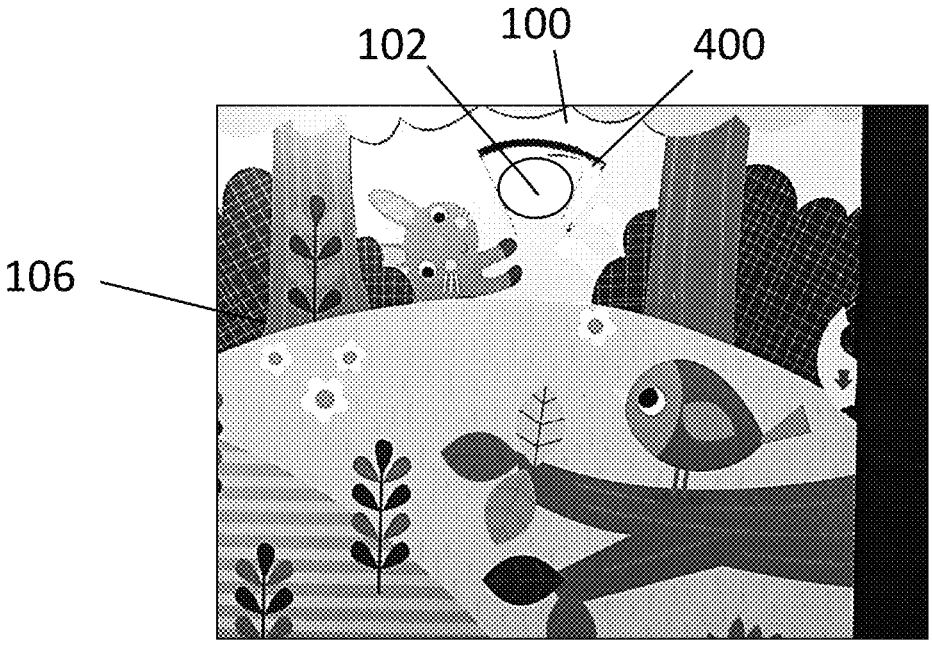

Yet another example is depicted in FIGS. 4A and 4B. In this example, the moving component 100 is a rotatable wheel with a window 400 formed therethrough. The moving component 100 is rotatably fixed between the top illustrative layer 106 and bottom base layer 108 such that it can rotate therebetween. Further, the moving component can be formed to include illustrations thereon such that rotating the moving component 100 moves various illustrations into view based on the cut-out form of the top illustrative layer 106. Additionally, rotating the moving component 100 causes the window 400 to rotate around such that at some point, the light sensor 102 is exposed through the window 400 to cause the corresponding sound to be emitted. For example and with respect to this particular illustration, rotating the moving component 100 (e.g., background wheel) causes a first rabbit to rotate behind a foreground bush (formed on the top illustrative layer 106) and a second rabbit to appear and become exposed.

Figure 5A:
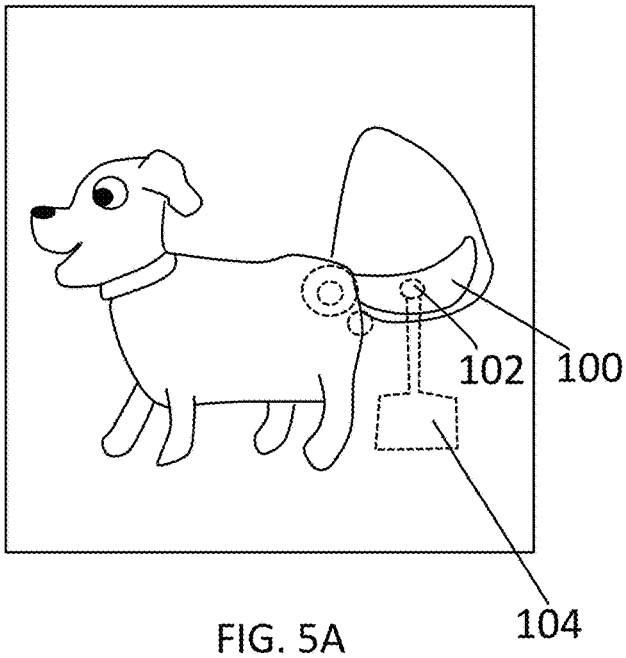
FIG. 5A is an illustration of a page or puzzle piece with a moving component in a first position.
Figure 5B:
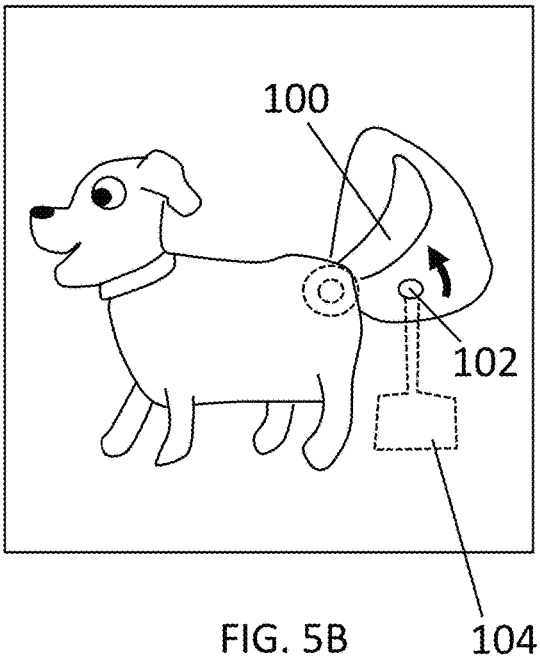
FIG. 5B is an illustration of the page or puzzle piece as shown in FIG. 5A, depicting the moving component in the second position to expose a sensor.

The concept of the moving component 100 is further illustrated in FIGS. 5A and 5B, which depict an example in which the moving component 100 is a dog's tail. Rotating the moving component 100 in this example from a first position to a second position exposes the light sensor 102 to cause the corresponding sound to be emitted by the circuitry and/or speaker 104.

Figure 6A:
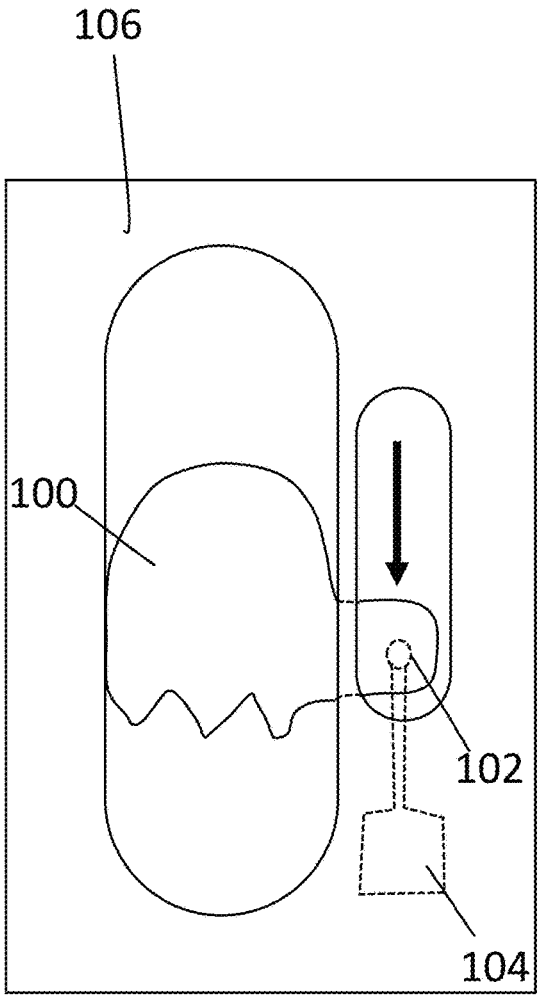
FIG. 6A is an illustration of a page or puzzle piece with a moving component in a first position.
Figure 6B:
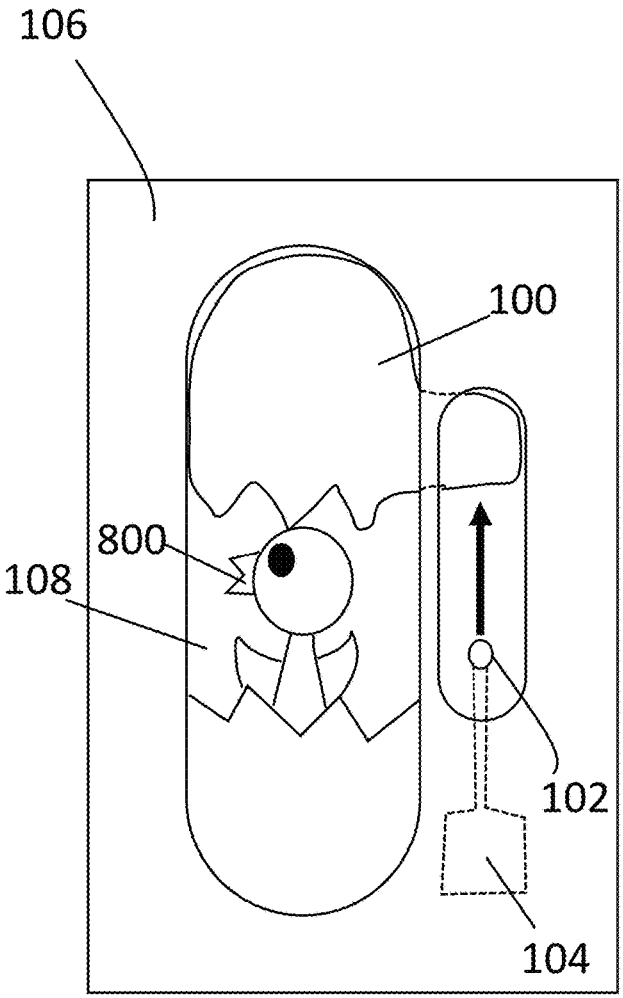
FIG. 6B is an illustration of the page or puzzle piece as shown in FIG. 6A, depicting the moving component in the second position to expose a sensor.

As noted above, the moving component 100 can also be slid between the various slayers of the board. As shown in FIGS. 6A and 6B, the moving component 100 can be slideably positioned between the top illustrative layer 106 and bottom base layer 108. Upon sliding the moving component 100 (for example, using a tab portion), the sensor 102 is exposed as well as additional illustrative content printed, painted, adhered, or otherwise formed on the bottom base layer 108.

Figure 7A:
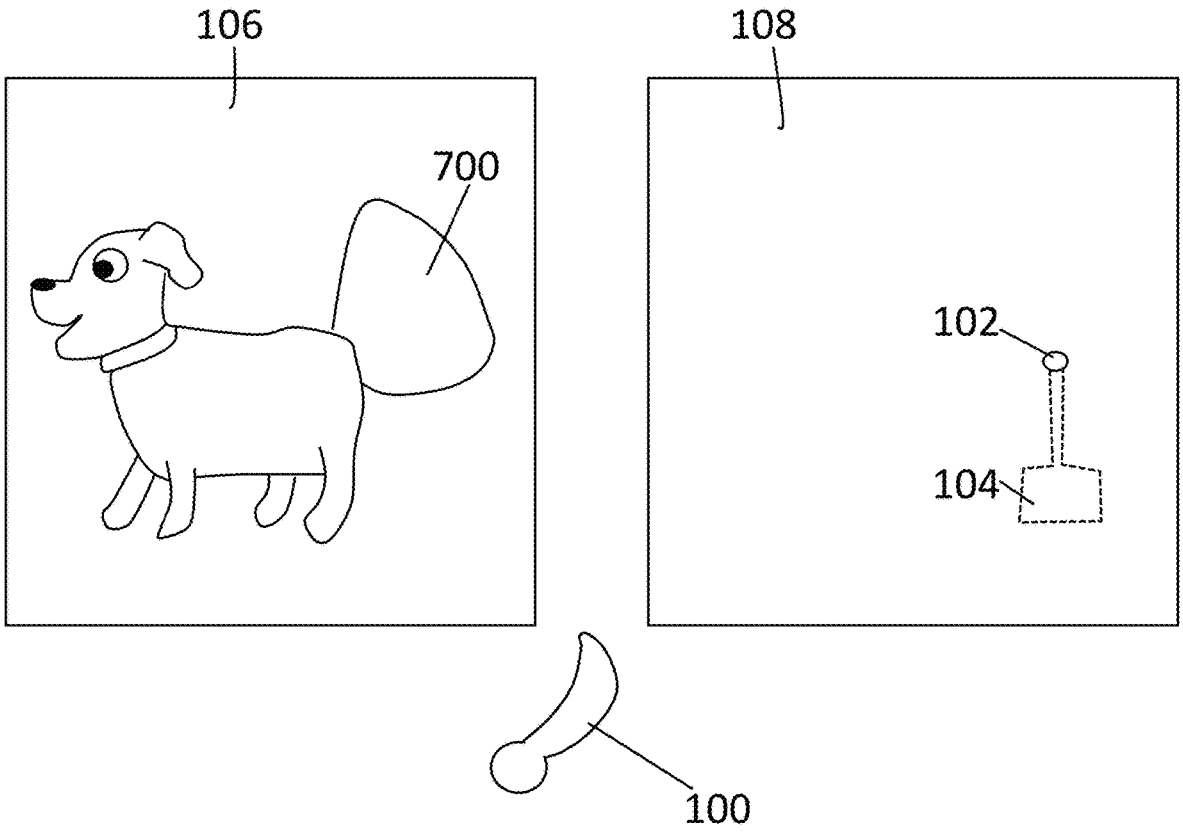
FIG. 7A is an illustration of a top illustrative layer, a moving component, and a bottom base layer according to various embodiments of the present invention.
Figure 7B:
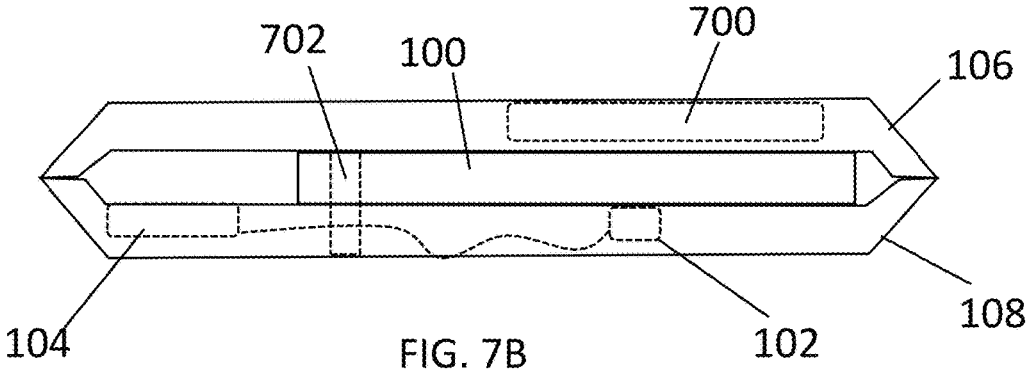
FIG. 7B is a cross-sectional, side-view illustration of the top illustrative layer, moving component, and bottom base layer according to various embodiments of the present invention.

For further understanding, FIG. 7A provides an illustration of an example of a top illustrative layer 106, the moving component 100, and a bottom base layer 108 (with sensor 102 and circuit and/or speaker 104 embedded therein (or otherwise affixed with the board)). In this example, the top illustrative layer 106 includes a window 700 cut therefrom. As shown in FIG. 7B, the moving component 100 can be rotatably connected 702 between the top illustrative layer 106 and bottom base layer 700 such that the moving component 100 is visible through the window 700. Further, if the moving component 100 is rotated (as shown in FIG. 5B), the sensor 102 is exposed through the window 700 to actuate the circuit and/or speaker 104.

In some aspect, the top illustrative layer 106 is connected with the bottom base layer 108 using any suitable technique as understood by those skilled in the art. For example, the top illustrative layer 106 can be integrally formed with the bottom base layer 108, such as a cardboard sheet that is folded in half to form two layers. As another non-limiting example, the two layers 106 and 108 can be glued to one another. Thus, any suitable technique can be employed to form a board that includes a moving component 100 movably connected with respect to the top illustrative layer 106 and a bottom base layer 108.

In another aspect, the moving component 100 can be removably attached with the bottom base layer 108. For example, the bottom base layer 108 can serve as a puzzle base with the top illustrative layer 106 having one or more cut-out shapes (such as the windows previously described) that are formed to accommodate and match with a moving component 100. In this example, the moving component 100 can be a puzzle piece that fits within the cut-out shapes (in a first position) in the top illustrative layer 106 and that can be lifted from the board (in a second position) to expose a light sensor 102 attached with the bottom base layer 108. Additionally and in various aspect, the layers 106, 108, and 100 can be formed of any suitable material to collectively form the board, non-limiting examples of which include paperboard, plastic, and wood.

In the sliding aspect and as understood by those skilled in the art, the moving component is sandwiched between the top illustrative layer 106 and bottom base layer 108 such that the moving component 100 can be optionally slid between a first and second position to cover or expose the sensor 102. It should also be understood that the invention described herein includes all of the necessary components as may be needed to impart the functionality and invention as described to provide actions and sounds in a new, intuitive way that engages the child's visual and auditory senses.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A board for use as a book page or puzzle with a moving action piece, comprising:

a generally planar top illustrative layer having a first illustration;

a bottom base layer attached with the top illustrative layer, the bottom base layer having a light sensor and sound generation components for generating a sound based upon actuation of the light sensor;

a moving component movably connected with the bottom base layer;

wherein the light sensor is connected with the bottom base layer and positioned such that moving the moving component from a first position to a second position exposes the light sensor to cause the sound generation components to generate a sound; and wherein moving the moving component from the first to second position alters an illustration as viewable by a user by exposing a second illustration that is coordinated with the first illustration such that the first and second illustrations are positioned viewably adjacent one another and, in doing so, exposes the light sensor.

2. The board as set forth in claim 1, wherein the moving component is movably connected in a lateral plane between the top illustrative layer and the bottom base layer such that at least a portion of the moving component is sandwiched between the top illustrative layer and the bottom base layer.

3. The board as set forth in claim 1, wherein the moving component is slidably sandwiched between the top illustrative layer and bottom base layer.

4. The board as set forth in claim 1, wherein the moving component is pivotally sandwiched between the top illustrative layer and bottom base layer.

5. The board as set forth in claim 1, wherein the top illustrative layer, moving component, and bottom base layer collectively form a page of a book.

6. The board as set forth in claim 1, wherein board is a puzzle board, such that the top illustrative layer includes a cut-out shape and the moving component is formed to match with and fit within the cut-out shape.

* * * * *